US010559444B2

(12) United States Patent
Tsang et al.

(10) Patent No.: US 10,559,444 B2
(45) Date of Patent: Feb. 11, 2020

(54) FUSE DEVICE HAVING PHASE CHANGE MATERIAL

(71) Applicant: Littelfuse, Inc., Chicago, IL (US)

(72) Inventors: Chun-Kwan Tsang, Morgan Hill, CA (US); Jianhua Chen, Sunnyvale, CA (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 15/581,050

(22) Filed: Apr. 28, 2017

(65) Prior Publication Data

US 2018/0315576 A1 Nov. 1, 2018

(51) Int. Cl.

| | |
|---|---|
| ***H01H 85/12*** | (2006.01) |
| ***H01C 7/10*** | (2006.01) |
| ***H01C 7/02*** | (2006.01) |
| ***H01H 85/06*** | (2006.01) |

(52) U.S. Cl.

CPC ..... *H01H 85/12* (2013.01); *H01C 7/02* (2013.01); *H01C 7/10* (2013.01); *H01H 85/06* (2013.01)

(58) Field of Classification Search

CPC ..... H01C 7/02; H01C 7/10; H01C 1/1406; H01C 7/027; H01C 7/1006; H01C 7/108; H01C 17/06513; H01C 17/06586; H01H 37/761; H01H 2037/762–763; H01H 85/0039; H01H 85/0043; H01H 85/0047; H01H 85/0052; H01H 85/0056; H01H 85/048; H01H 85/06; H01H 85/12; H01H 85/36; H01H 2085/0486; H01H 2085/0483

USPC ..... 337/1

See application file for complete search history.

(56) References Cited

U.S. PATENT DOCUMENTS

| | | | | |
|---|---|---|---|---|
| 5,386,335 | A * | 1/1995 | Amano | H01C 7/10 338/20 |
| 6,396,383 | B1 * | 5/2002 | Glatz-Reichenbach | H01C 7/027 338/22 R |
| 7,598,840 | B2 * | 10/2009 | Lu | H01C 7/126 337/183 |
| 7,741,946 | B2 * | 6/2010 | Ho | H01C 7/102 337/405 |
| 8,587,945 | B1 * | 11/2013 | Hartmann | H05K 7/20454 361/679.53 |
| 2001/0055187 | A1 * | 12/2001 | McLoughlin | H01C 7/126 361/127 |

(Continued)

FOREIGN PATENT DOCUMENTS

| | | | |
|---|---|---|---|
| CN | 1132398 | A | 10/1996 |
| CN | 1387214 | A | 12/2002 |
| DE | 102013217407 | B3 | 1/2015 |

OTHER PUBLICATIONS

European Search Report for the European Patent Application No. EP8169729, dated Sep. 10, 2018, 2 pages.

*Primary Examiner* — Jacob R Crum

(57) ABSTRACT

A fuse device including a fuse component, a first electrode, disposed on a first side of the fuse component, a second electrode, disposed on a second side of the fuse component, and a phase change component, disposed in thermal contact with the fuse component. The fuse component may comprise a fuse temperature, wherein the phase change component exhibits a phase change temperature, the phase change temperature marking a phase transition of the phase change component, and wherein the phase change temperature is less than the fuse temperature.

16 Claims, 6 Drawing Sheets

(56) References Cited

U.S. PATENT DOCUMENTS

| | | | | |
|---|---|---|---|---|
| 2008/0157917 | A1* | 7/2008 | Tu | H01C 7/10<br>338/22 R |
| 2011/0011621 | A1 | 1/2011 | Hyde et al. | |
| 2013/0182362 | A1* | 7/2013 | Chen | H01C 1/08<br>361/111 |

* cited by examiner

FUSE DEVICE HAVING PHASE CHANGE MATERIAL

BACKGROUND

Field

Embodiments relate to the field of circuit protection devices, including fuse devices.

Discussion of Related Art

Conventional circuit protection devices include fuses, resettable fuses, positive temperature coefficient (PTC) devices, where the latter devices may be considered resettable fuses. In devices such as resettable fuses as well as non-resettable fuses, the circuit protection device may be designed to exhibit low resistance when operating under designed conditions, such as low current. The resistance of the circuit protection device, including a circuit protection element, may be altered by direct heating due to temperature increase in the environment of the circuit protection element, or via resistive heating generated by electrical current passing through the circuit protection element. For example, a PTC device may include a polymer material and a conductive filler that provides a mixture that transitions from a low resistance state to a high resistance state, due to changes in the polymer material, such as a melting transition or a glass transition. At such a transition temperature, often above room temperature, the polymer matrix may expand and disrupt the electrically conductive network, rendering the composite much less electrically conductive. This change in resistance imparts a fuse-like character to the PTC materials, which resistance may be reversible when the PTC material cools back to room temperature. In the case of non-resettable fuses, the material of a fuse element may melt or vaporize, leading to an open circuit condition. The rapidity of the transition from low resistance to high resistance, or response time, may be governed by the inherent properties of the material used in a fuse device, such as a metal alloy in a non-resettable fuse, or a polymer/filler material in a PTC fuse. For some applications, the response time may be more rapid than ideal, meaning that a longer response time is more appropriate.

With respect to these and other considerations, the present disclosure is provided.

SUMMARY

Exemplary embodiments are directed to improved materials and devices based upon a combination of phase change materials and fuse devices.

In one embodiment, a fuse device may include a fuse component; a first electrode, disposed on a first side of the fuse component; a second electrode, disposed on a second side of the fuse component; and a phase change component, disposed in thermal contact with the fuse component, wherein the fuse component comprises a fuse temperature; wherein the phase change component exhibits a phase change temperature, the phase change temperature marking a phase transition of the phase change component, and wherein the phase change temperature is less than the fuse temperature.

In another embodiment, In another embodiment, a method of forming a fuse device may include forming a first electrode on a first side of a fuse component; forming a second electrode on a second side of the fuse component; and applying a phase change component in thermal contact with the fuse component, wherein the fuse component comprises a fuse temperature, wherein the phase change component exhibits a phase change temperature, the phase change temperature marking a phase transition of the phase change material, and wherein the phase change temperature is less than the fuse temperature.

In a further embodiment, a protection device may include a metal oxide varistor; a first electrode, disposed on a first side of the metal oxide varistor, a second electrode, disposed on a second side of the metal oxide varistor, and a third electrode, disposed on the second side of the metal oxide varistor. The protection device may also include a thermal fuse element, connected between the second electrode and the third electrode, and a phase change layer, the phase change layer comprising a phase change material, being disposed on the second side of the metal oxide varistor, and being disposed in thermal contact with the thermal fuse.

DESCRIPTION OF EMBODIMENTS

Figure 1:
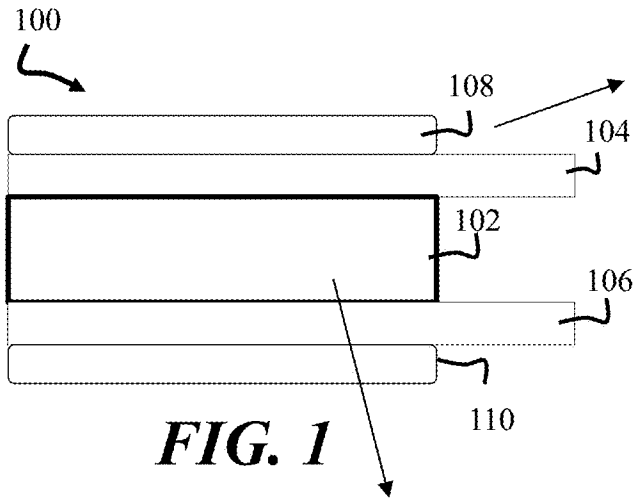
FIG. 1 illustrates a fuse device according to embodiments of the disclosure.

The present embodiments will now be described more fully hereinafter with reference to the accompanying drawings, in which exemplary embodiments are shown. The embodiments are not to be construed as limited to the embodiments set forth herein. Rather, these embodiments are provided so that this disclosure will be thorough and complete, and will fully convey their scope to those skilled in the art. In the drawings, like numbers refer to like elements throughout.

In the following description and/or claims, the terms "on," "overlying," "disposed on" and "over" may be used in the following description and claims. "On," "overlying," "disposed on" and "over" may be used to indicate that two or more elements are in direct physical contact with one another. Also, the term "on,", "overlying," "disposed on," and "over", may mean that two or more elements are not in direct contact with one another. For example, "over" may mean that one element is above another element while not contacting one another and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

In various embodiments, novel device structures and materials are provided for forming a fuse device, where the fuse device response time may be adjusted using a phase change component. FIG. 1 illustrates a fuse device 100 according to embodiments of the disclosure. The fuse device 100 may include a fuse component 102, a first electrode 104, disposed on a first side of the fuse component 102, a second electrode 106, disposed on a second side of the fuse component 102, and a phase change component 108, disposed in thermal contact with the fuse component 102. The fuse device 100 also includes a phase change component 110, disposed on an outside of the second electrode 106 and in thermal contact with the fuse component 102. As shown, the first electrode 104 has an inner side disposed in contact with the fuse component 102 and an outer side in contact with the phase change component 110. In the fuse device 100 of FIG. 1, the fuse component 102 may be a thermal fuse, a current fuse, a resettable fuse, a non-resettable fuse, a positive temperature coefficient (PTC) fuse, or other fuse as known in the art. For example, the fuse component 102 may comprise a PTC material, where the PTC material is characterized by a fuse temperature (trip temperature) separating a low resistance state of the PTC material from a high resistance state of the PTC material. As used herein, the term "thermal contact" or "in thermal contact with" may refer to a first component that is in physical contact with a second component, or is connected to the second component by a high thermal conductivity path. For example, in the fuse device 100 the first electrode 104 or second electrode 106 may be a metal sheet such as copper, or metal lead, where the metal has high thermal conductivity. As such, while the phase change component 108 is separated from the fuse component 102 by the first electrode 104, the phase change component 108 is yet in thermal contact with the fuse component 102 by virtue of the high thermal conductivity path provided by the first electrode 104.

In various embodiments, the material used in the phase change component 108 may be any appropriate material including a polymer, a wax, a metal, metal alloy, a salt hydrate, or a eutectic material. Among eutectic materials are organic-organic systems, organic-inorganic systems, as well as inorganic-inorganic systems. The embodiments are not limited in this context.

Figure 2:
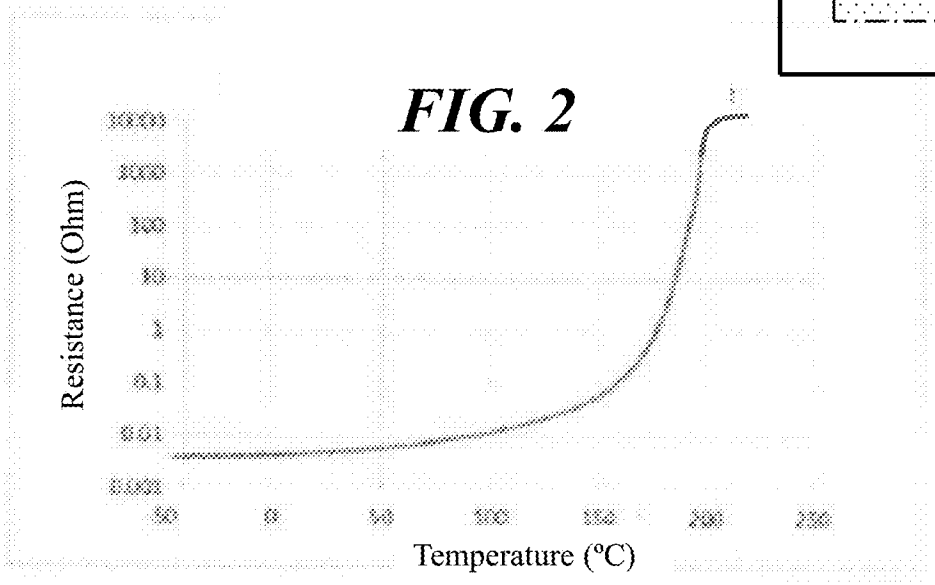
FIG. 2 provides a characteristic electrical behavior of a PTC material.

FIG. 2 provides a characteristic electrical behavior of a PTC material. As shown, at lower temperatures, in the low resistance state, the electrical resistance is relatively lower, and increases very little as a function of increasing temperature. At a given temperature, sometimes referred to as a fuse temperature or trip temperature (in this example, at approximately 170° C.), a rapid increase in electrical resistance takes place as a function of increasing temperature, where the PTC material enters a high resistance state. In the high resistance state, the electrical resistance is much higher than in the low resistance state, such as two orders of magnitude, three orders of magnitude, or four orders of magnitude higher. Once in the high resistance state, the electrical resistance of the PTC material may increase much more slowly with increasing temperature, or in some cases not at all. The current-limiting action of the PTC material at high temperatures accordingly is tripped when the PTC material transitions from the low resistance state to the high resistance state, which transition is characterized by a temperature that depends on the materials used to form the PTC material. For example, a polymer matrix material may undergo a melting transition over a small temperature range where the polymer matrix rapidly expands. This temperature range may be set according to the polymer material and the application of the PTC material. For some applications, a useful transition temperature may be in the range of 160° C. to 180° C. The embodiments are not limited in this context.

According to some embodiments, where the fuse component 102 of fuse device 100 is a PTC material, the fuse component 102 may enter a high resistance state above a fuse temperature of approximately 160° C. or so. While the fuse device 100 may enter the high resistance state when the temperature of the fuse component 102 exceeds 160° C., advantageously, the phase change component 108 may provide a fuse delay that increases the response time of the fuse device 100. In other words, as the fuse device 100 heats up, and in particular, as the fuse component 102 heats up, the phase change component 108 may act to delay the time that the fuse device 100 reaches a fuse temperature. In particular, the phase change component 108 may be characterized by a phase change temperature that marks a phase transition of material of the phase change component 108. In particular, the fuse device 100 is arranged wherein the phase change temperature of the phase change component 108 is less than the fuse temperature of the fuse component 102. As explained below, this arrangement ensures that more heat is absorbed by the fuse device 100 to heat the fuse device to the fuse temperature, than would otherwise be used if the phase change component 108 were absent.

Figure 3:
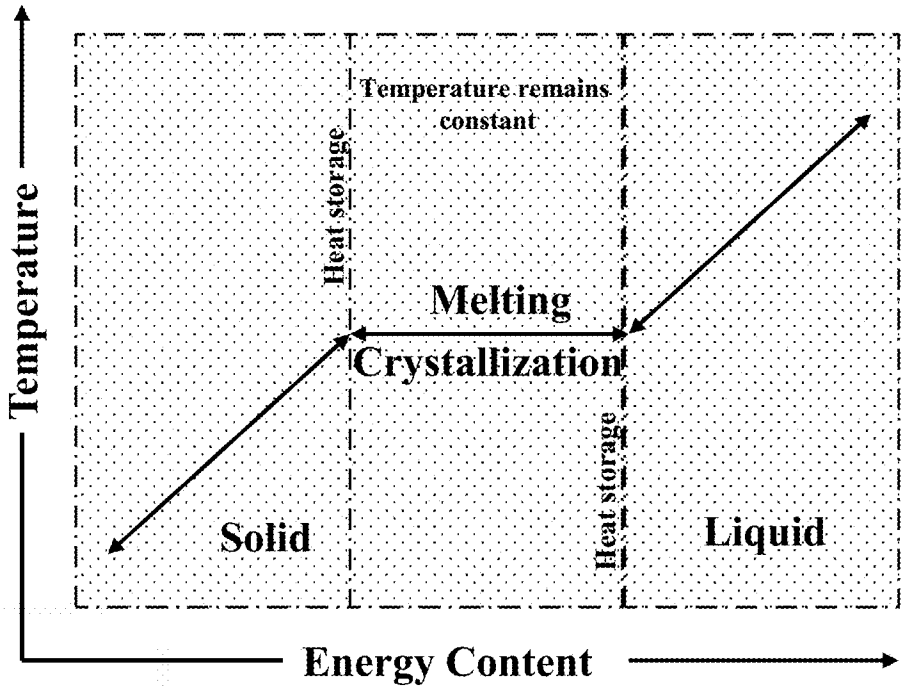
FIG. 3 illustrates general properties of a PCM substance.

FIG. 3 illustrates general properties of a PCM substance, where the phase change component 108 may include such as PCM substance. Known phase change materials may be used as heat storage materials, where thermal energy transfer occurs when a materials change takes place, such as from solid to liquid or liquid to solid, solid to solid, solid to gas or liquid to gas, and vice versa. For a PCM based on solid to solid transitions, heat is stored as the materials is transformed from one crystalline to another. For a solid-to-liquid PCM, the PCM absorbs heat in the solid phase during heating, causing a rise of temperature, as shown in the left portion of FIG. 3. When the PCM reaches the melting point, a large amount of heat is absorbed during the solid phase to liquid phase transition. As indicated in FIG. 3, this transition may take place at an almost constant temperature. The PCM then continues to absorb heat without a significant rise in temperature until all the material of the PCM is transformed to a liquid phase. The amount of heat (energy) required to melt a substance may be referred to as the latent heat of melting. In the present embodiments, by adding a phase change component 108 to a fuse device, the overall mass of the fuse device may be increased, increasing the mass to be heated to generate a temperature increase over any given temperature range. Additionally, further energy (heat) is needed to heat the fuse device 100 to higher temperatures once the phase change temperature is reached, due to the latent heat of melting of material of the phase change component 108. This further energy needed results in an overall increase in the heat that is input into the fuse component 102 before the fuse temperature is reached as compared to known fuse devices that lack the phase change component 108.

Figure 4:
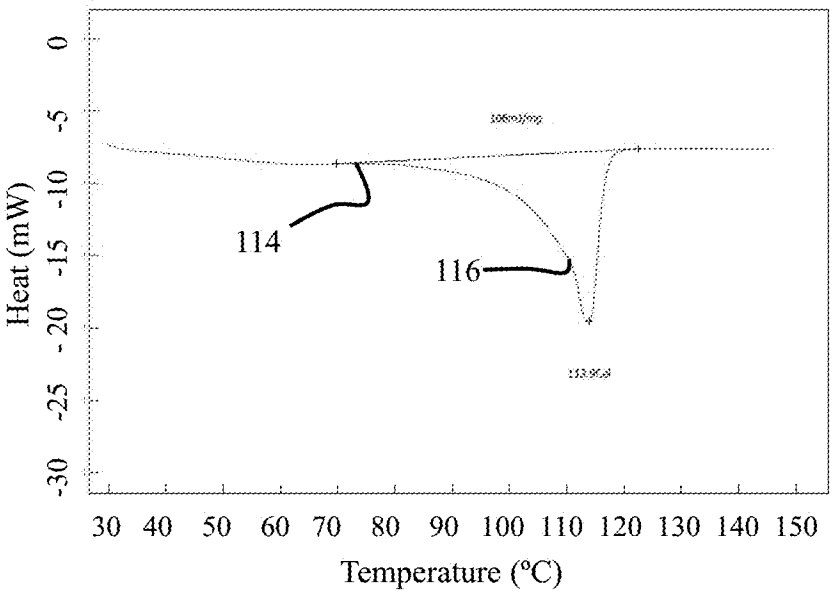
FIG. 4 shows an exemplary experimental heating curve, characteristic of a phase change material according to embodiments of the disclosure.

Accordingly, by appropriate design of the phase change component 108, the response time of the fuse 100 may be increased as desired, according to a target application. Turning to FIG. 4 there is shown an exemplary experimental heating curve 114, characteristic of a phase change material according to embodiments of the disclosure. In this example, the experimental heating curve 114 exhibits an endothermic peak 116 at approximately 110° C., characteristic of a melting phase transition. The material measured in FIG. 4 is a polyethylene-based polymer. Accordingly, such a polymer may be appropriate for used in the phase change component 108, where the fuse component 102 exhibits a higher fuse temperature, such as above 150° C. In other words, since the melting transition of the phase change material of FIG. 4 occurs at 110° C., any fuse having a fuse component that has a fuse temperature above 110° C. may have a delayed response time, due to the extra heat used to melt the phase change component at 110° C. Said differently, the fuse response time for a fuse component having a fuse temperature in excess of a phase change component temperature will be delayed by the presence of the phase change component, assuming that the phase change component has the same temperature as the fuse component during heating.

Notably, while FIG. 4 particularly illustrates an example of a solid-liquid phase change material, in other embodiments a phase change material may experience other transitions, as noted. For example, during heating a solid phase change material may undergo a solid-solid phase transition that is endothermic, as well known in the art. In such an example, heat is required to transform the solid from a low temperature phase to a high temperature phase. During the solid-solid phase transition, the overall temperature of the phase change material may remain almost constant, as in the aforementioned embodiments.

Figure 5:
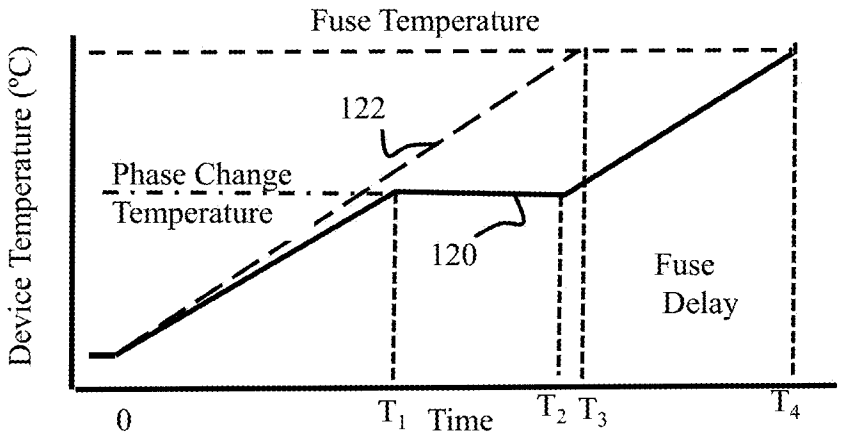
FIG. 5 presents a graph showing a response curve for a fuse device according to embodiments of the present disclosure.

FIG. 5 presents a graph showing a response curve 120 for a fuse device according to embodiments of the present disclosure, such as the fuse device 100. The response curve 120 represents the temperature of a fuse component, or fuse device as a whole, in the time span of an overcurrent event. As such, temperature of the fuse component is plotted as a function of time. At time of zero, the assumption is that the beginning of a fault condition takes place, where fault current begins to travel through the fuse.

By way of background, as briefly discussed above, known fuses may be characterized by a response time or a time to trip, representing the time from an onset of fault current until the fuse trips. When a fault condition occurs, high levels of electrical current pass through the fuse, so that total Joule heating is generated according to the current and duration of the event: Energy=($I^2R$)×Time. The temperature within various components of a fuse device may accordingly rises because of the Joule heating. Among factors that affect response time of known fuses is the rate of the temperature increase of the fuse that relates to fault current (I), resistance of the fuse (R), specific heat capacity, and thermal mass of the fuse. In particular, as Joule heating ($I^2R$) is generated by the fuse component, the energy generated results in a proportional increase in temperature, where Energy generated by Joule heating=material's mass×(specific heat capacity)×(increase in Temperature). When the fuse temperature reaches a given temperature, that is, the fuse temperature, at the response time, the fuse will be opened due to fuse blowing or tripping.

Returning to FIG. 5, there is shown in an initial period toward the left of the graph at the beginning of a fault current, a period where temperature increases monotonically as a function of time, representing the increase in temperature caused, for example, by Joule heating as current passes through a fuse element or fuse component. At a time $T_1$, the phase change temperature is reached by the fuse component or fuse as a whole. The phase change component, such as phase change component 108, being in thermal contact with the fuse component, also reaches the phase change temperature, such that the phase change material of phase change component 108 then begins to undergo a phase transition.

As further heat is generated by the fuse component after time $T_1$, because a characteristic amount of heat is needed to complete the phase transition for the phase change material, the phase change material and the fuse component may experience little or no temperature rise during the phase transition. This range is shown as the plateau between time $T_1$ and a time $T_2$, representing the time of completion of the phase change. After the time $T_2$, additional Joule heat generated by the fuse component by the fault current condition causes the phase change material, completely transformed into a new phase, as well as the fuse component, to increase in temperature as shown, until a time $T_4$, where a fuse temperature is reached. Also shown in FIG. 5 is a response curve 122, representing the thermal response of a known fuse device, lacking the phase change component of the present embodiments. As shown, after the time $T_1$, since no PCM is present, a fuse element continues to increase in temperature without pause until the fuse temperature is reached at time $T_3$. The slope of the response curve 122 for a known fuse device may also be higher due to the lesser overall mass, lacking PCM components.

As shown in FIG. 5, a fuse delay may be denoted as the difference between the time $T_3$ and the time $T_4$, and may be somewhat greater than the melting time, represented by the difference between $T_2$ and $T_1$.

With reference again to FIG. 1, for simplicity, the assumption may be that the thermal contact is sufficient that the phase change component 108 and fuse component 102 have the same temperature at a given time. Notably, the qualitative behavior of FIG. 5 still holds if the temperature of the phase change component 108 lags the temperature of the fuse component 102. The scenario where response curve 120 would not be generated is when poor thermal contact between a phase change material and fuse component exists, where the fuse temperature of the fuse component is reached before the phase change temperature is reached in the phase change material.

Figure 6:
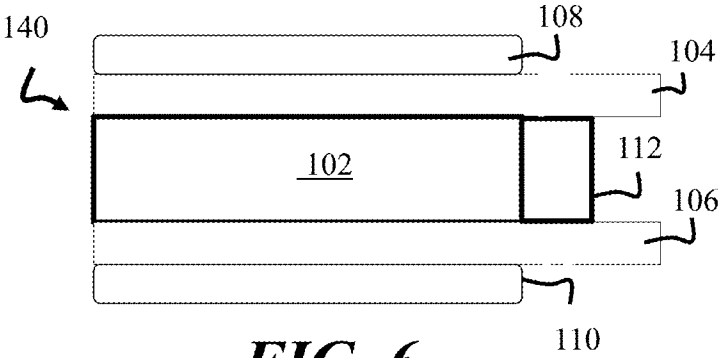
FIG. 6 shows a cross-sectional view of another fuse device, according to various embodiments of the disclosure.

Turning now to FIG. 6 there is shown another embodiment of a fuse device 140, according to further embodiments of the disclosure. The fuse device 140, in addition to the having some of the aforementioned components of fuse device 100, may include a phase change component 112, wherein the phase change component 112 is disposed between the first electrode 104 and the second electrode 106, and in direct contact with the fuse component 102. This configuration may provide more rapid overall transfer of heat from the fuse component 102 to phase change materials.

Figure 7:
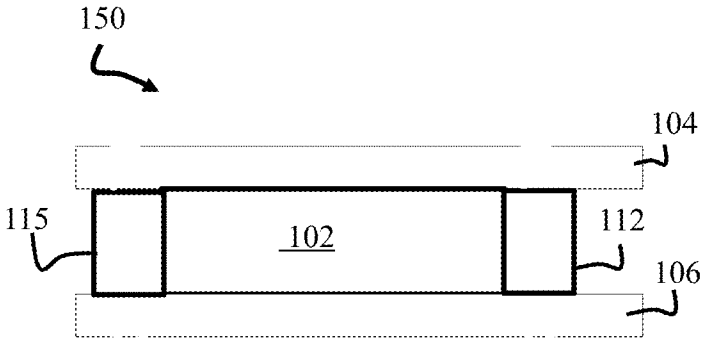
FIG. 7 shows a cross-sectional view of fuse device, according to some embodiments of the disclosure.

Turning now to FIG. 7 there is shown another embodiment of a fuse device 150, according to further embodiments of the disclosure. The fuse device 140, in addition to the having some of the aforementioned components of fuse device 100, may include a phase change component 112, as well as phase change component 115, wherein the phase change component 112 and phase change component 115 are disposed between the first electrode 104 and the second electrode 106, and in direct contact with the fuse component 102. In this embodiment, no phase change component is disposed outside of the first electrode 104 and second electrode 106. This configuration may provide lesser or greater amount of latent heat of phase transition as opposed to the configuration of FIG. 1, for example, depending upon the total volume of phase change material.

Figure 8:
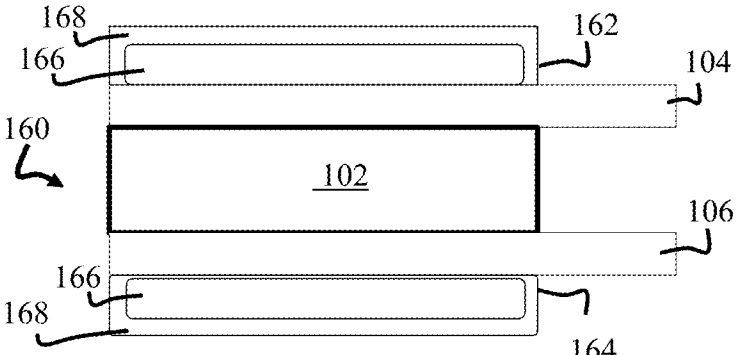
FIG. 8 shows a cross-sectional view of a fuse device according to other embodiments of the disclosure.

The physical macrostructure as well as microstructure of a phase change component may vary according to different embodiments. In some embodiments, a phase change component may be arranged as a layer, a sheet, a tape, a coating, or a block. The phase change component may contain just phase change material, or may be a composite material, having more than one material in some embodiments. FIG. 8 shows one embodiment of a fuse device 160, including a phase change component 162 and phase change component 164, where these phase change components include an encapsulant layer 168, as well as a phase change material 166, encapsulated by the encapsulant layer 168. The phase change material 166 may also be partially encapsulated by the first electrode 104, in the case of phase change component 162, or by second electrode 106, in the case of phase change component 164. Such a configuration may be appropriate for a phase change material 166 that becomes non-viscous after undergoing a phase transition, and may otherwise tend to flow at high temperatures. For example, the encapsulant layer 168 may be a high temperature polymer having a melting temperature above a fuse temperature of the fuse component 102. Accordingly, the fuse device 160 may endure multiple fusing events while maintaining mechanical integrity of the structure. While the embodiments of FIGS. 6-8 illustrate fuse devices where a phase change component is disposed in more than one location, in other embodiments, a phase change component may be located just in one location, such as just on one side of an electrode.

Figure 9:
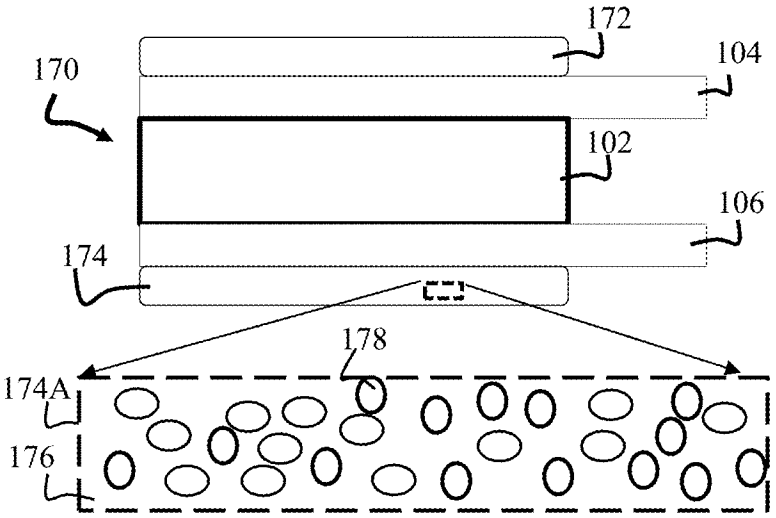
FIG. 9 depicts one embodiment of a cross-sectional view of fuse device according to additional embodiments of the disclosure.

In further embodiments, a phase change component may include a matrix material, and a plurality of microencapsulated particles, wherein the plurality of microencapsulated particles are dispersed within the matrix material. The plurality of microencapsulated particles may constitute a phase change material with a capsule wall. FIG. 9 depicts one embodiment of a fuse device 170, where a phase change component 172 and a phase change component 174 are provided, generally in the configuration of FIG. 1. In this embodiment, the phase change components may be a composite, wherein microencapsulated particles 178 are dispersed in a matrix material 176, as shown for the region 174A. In some embodiments, the microencapsulated particles 178 may be composed of phase change material, while the matrix material 176 does not exhibit a phase change, at least within the operating temperature of the fuse device 170. The microencapsulated particles 178 may have a size on the order of tens of micrometers, or micrometers, or sub-micrometers. The embodiments are not limited in this context.

As an example, the matrix material 176 may be a polymer. In some embodiments, the phase change component 174 and phase change component 172 may be characterized as a shape stabilized phase change material, including a cross-linked polymer matrix, represented by the matrix material 176, encompassing phase change material formed within microencapsulated particles 178. In operation, when the fuse component 102 experiences a fault current and heats up, the phase change component 172 and phase change component 174 may remain relatively rigid up to and through a fuse event taking place, for example, at 180° C. At a temperature of 120° C., for example, the phase change substance of the microencapsulated particles 178 may undergo a melting transition, while the cross-linked polymer matrix remains relatively rigid. In this manner, the phase change component 174 acts as a large thermal sink at a temperature below the fuse temperature, while still maintaining mechanical integrity.

Figure 10:
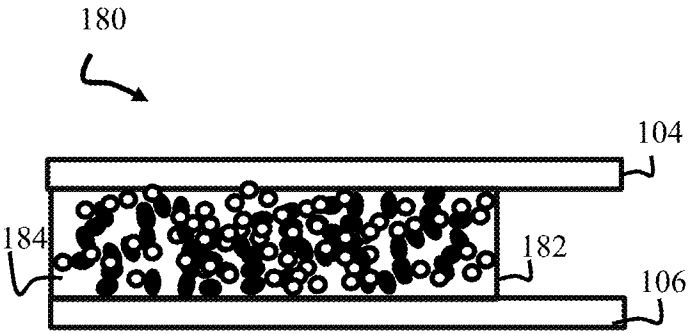
FIG. 10 depicts a view of a fuse device according to further embodiments of the disclosure.

In still further embodiments, a phase change component may include a plurality of microencapsulated particles, where the plurality of microencapsulated particles are dispersed within a PTC material. FIG. 10 depicts an embodiment of a fuse device 180, where the fuse device 180 includes a composite element 182, disposed between the first electrode 104 and the second electrode 106. The composite element 182 may act as a delayed fuse and may include a matrix 184, where the matrix 184 may have a similar composition to the matrix polymer material of known PTC fuses. The composite element 182 may further include a conductive filler, shown in dark circles, where the matrix 184 and conductive filler provide a fuse temperature and behavior similar to conventional PTC fuses. The composite element may further include a plurality of microencapsulated particles, shown in open circles, and composed of a phase change material having a phase change temperature below the fuse temperature generated by the matrix 184 and conductive filler. By adjusting the amount of phase change material in the composite element 182, the fuse delay may be adjusted.

Figure 11:
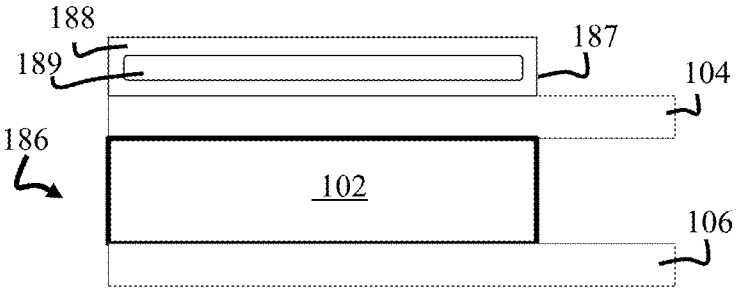
FIG. 11 depicts a cross-section of an additional fuse device, according to further embodiments of the disclosure.

FIG. 11 depicts a cross-section of an additional fuse device, fuse device 186, according to further embodiments of the disclosure. In this embodiment, in addition to the aforementioned components of a fuse device that are labeled similarly, the fuse device 186 includes a phase change component 187, arranged as a container 188. The container 188 while shown as adjacent the first electrode 104, may be arranged in any convenient location, in thermal contact with the fuse component 102. In addition, there may be more than one container 188 in some embodiments. Advantageously, the container 188 may completely encapsulate a phase change material 189, where the phase change material 189 may be a liquid in some embodiments. In this manner, the phase change component 187 provides a robust and stable configuration for using phase change materials that may be in a liquid state, either below a phase transition temperature, above the phase transition temperature, or both below and above the phase transition temperature.

Figure 12A:
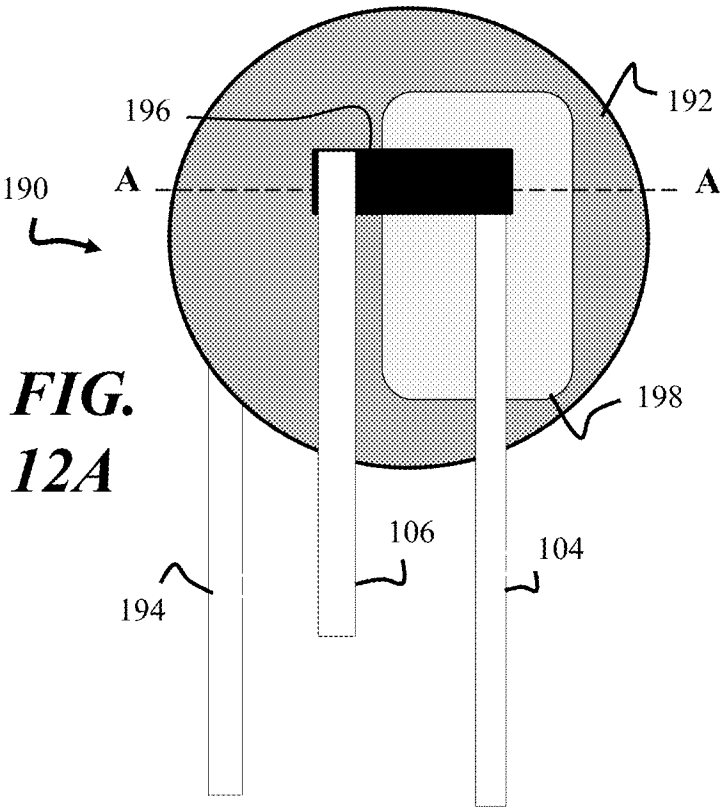
FIG. 12A and FIG. 12B depict a top plan view and a side cross-sectional view, respectively, of a fuse device according to further embodiments of the disclosure.
Figure 12B:
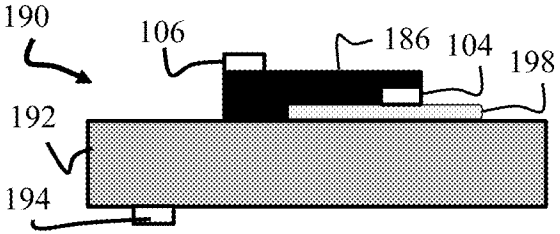

In still further embodiments, a phase change material may be integrated into an overvoltage control device, such as a metal oxide varistor (MOV). FIG. 12A and FIG. 12B depict a top plan view and a side cross-sectional view, respectively, of a fuse device 190 according to further embodiments of the disclosure. In this device, a varistor body 192 is provided. A first electrode 104 and second electrode 106 are generally disposed on a first side (top side in FIG. 11B) of the varistor body 192, while a third electrode 194 is disposed on the second side of the varistor body 192. A fuse component shown as thermal fuse 196 is connected between the first electrode 104 and the second electrode 10, and also disposed on the first side of the varistor body 192. As such the thermal fuse 196 is designed to fuse at a fuse temperature, as in known MOV devices protected by such a thermal fuse 196. The fuse device 190 further includes a phase change component 198, disposed as a layer on the first side of the varistor body 192, and in thermal contact with the thermal fuse 196. The phase change component 198 may have a phase change temperature below the fuse temperature of the thermal fuse 196, and accordingly provide a fuse delay as discussed previously. More particularly, a result of adding the phase change component 198 to a MOV device is to increase current surge capability of the thermal fuse. In particular, the thermal fuse 196, by virtue of being thermally coupled to the phase change component 198, may be able to pass 10 kA or 25 kA current surge at shot pulse without fusing. Said differently, the phase change component 198 may absorb a large portion of the heat generated in such a current surge, accordingly delaying or preventing a fuse open until surge current exceeds 25 kA or more.

In various embodiments, a fuse device may be arranged with a phase change component in a protection device to operate in a range of temperatures, such as −50° C. to 200° C. By providing a fuse delay using a PCM component, fusing events may be delayed, and excessive heating above the phase change temperature may be reduced due to the ability of the phase change material to absorb Joule heat while not increasing temperature. In some instances, tripping of a fuse may be avoided when fault current is not excessive. This avoidance of fusing events may be especially useful when moderate Joule heating may be repeatedly generated at heat levels where the Joule heating would otherwise cause a fusing event, absent the phase change component. For automotive applications, such as for protection of apparatus like power windows, repeated use of an apparatus for short periods of time may be useful, while not causing a fuse to trip. In one series of experiments, a control fuse device and a fuse device, arranged according to the present embodiments, were operated according to a protocol to simulate operation of power windows. The devices where cycled through a series of current cycles comprising delivery of 7.5 A for 5 seconds, 21.5 A for 1 second, followed by 1 second pause, at 80° C. with a resistance of 8.8 mOhm. The fuse device having the phase change material was based upon a PTC fuse component and polyethylene based phase change material (PCM), while the control device was a known PTC fuse structure. While the fuse device with the PCM component passed ten full cycles, the control device, lacking the PCM component, failed after 3.5 cycles.

In another set of experiments using a control fuse device based upon PTC fuse and an improved device including PTC component and PCM component, a 12A steady current was passed through the devices. The control fuse device was tripped after 55 seconds, while the improved device did not trip until 95 seconds.

Figure 13:
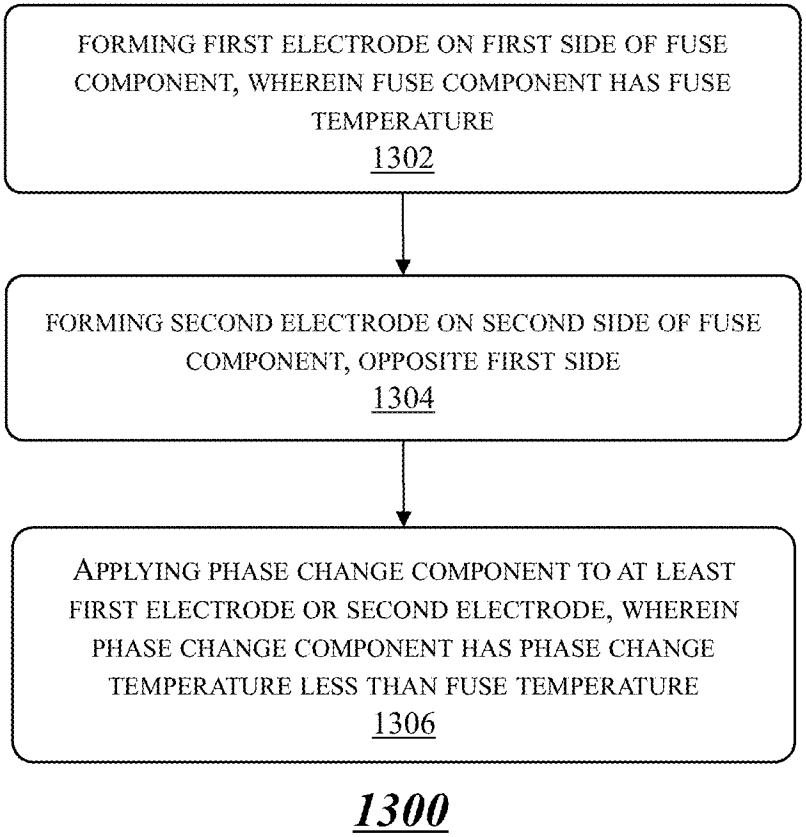
FIG. 13 depicts an exemplary process flow according to embodiments of the disclosure.

FIG. 13 depicts an exemplary process flow according to embodiments of the disclosure. At block 1302, a first electrode is formed on a first side of a fuse component. In various embodiments the fuse component may be a resettable fuse material, such as a PTC fuse, or a non-resettable fuse, such as a metal. The fuse component may be characterized by a fuse temperature or a trip temperature, where in particular embodiments, the fuse temperature is greater than 150° C.

At block 1304 a second electrode is formed on a second side of the fuse component, generally opposite the first side of the fuse component. According to various embodiments, the first electrode and the second electrode may be metals, such as highly thermally conductive metals including copper and the like. The electrodes may be leads, foils, coatings, or a combination of these features.

At block 1306, a phase change component is applied to at least one of the first electrode and the second electrode. The phase change component may be characterized by a phase change temperature associated with a phase change material that forms at least a part of the phase change component. The phase change temperature may be less than the fuse temperature of the fuse component. The phase change component may be applied as a discrete part, such as a block, or may be applied as a dipped coating, a tape, a mesh structure, or other feature. After application, the phase change component may be in thermal contact with the fuse component.

In various embodiments, the phase change component may be applied as a composite structure, such as an encapsulating layer surrounding a phase change material. In other embodiments, a composite structure may entail a polymer matrix, where a plurality of microencapsulated particles made from a phase change material are dispersed within the polymer matrix.

In particular embodiments, a shape-stabilized phase change component may be formed by applying an uncrosslinked polymer material to an electrode, where the uncrosslinked polymer material includes a plurality of microencapsulated particles made from a phase change material. The uncrosslinked polymer and microencapsulated particles may be well mixed, and coextruded to a predetermined shape, for example. After forming and applying the uncrosslinked polymer material, heat, radiation, additives, or other agents may be applied to form a cross-linked polymer material hosting the microencapsulated particles.

Figure 14:
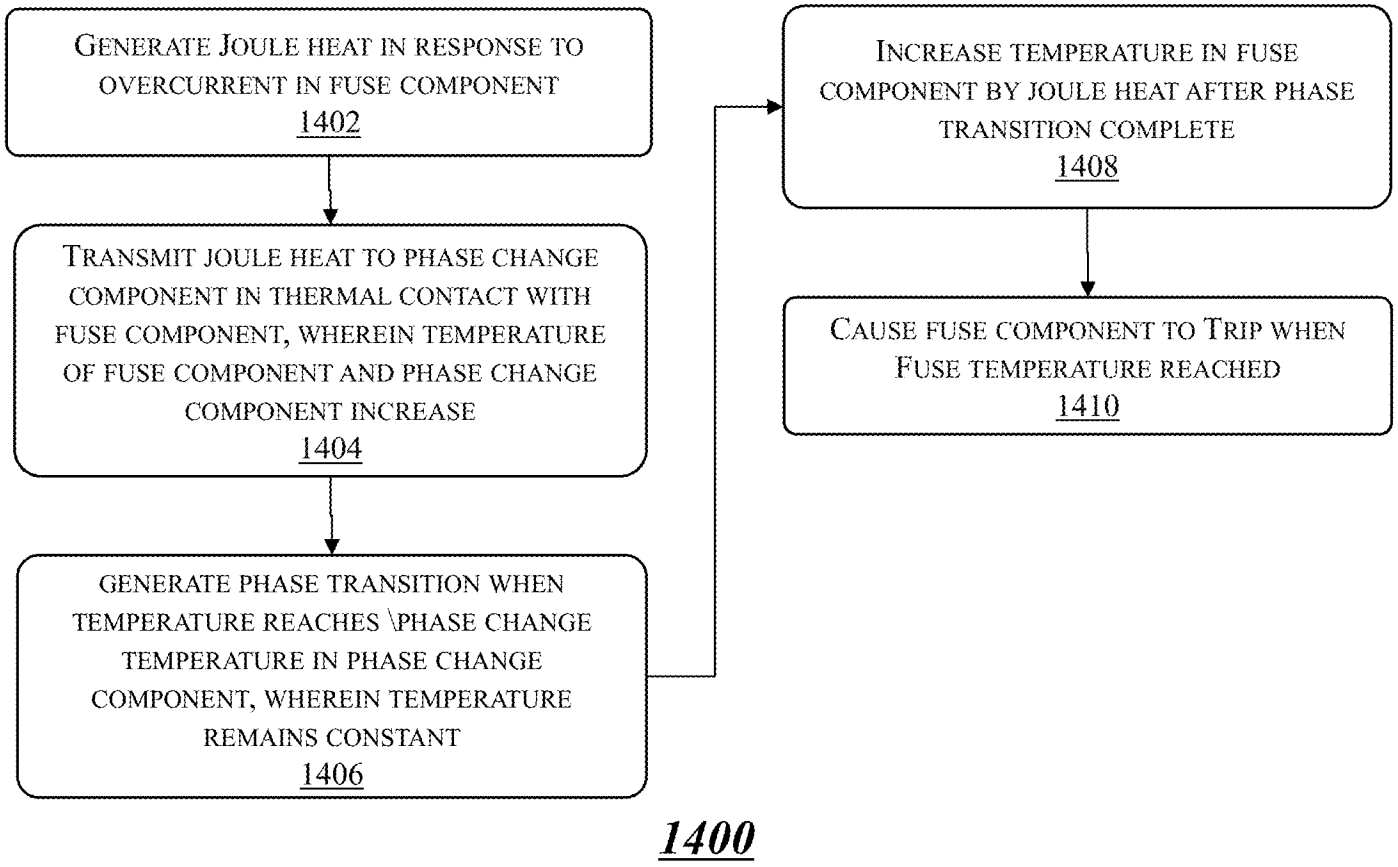
FIG. 14 depicts another exemplary process flow according to additional embodiments of the disclosure.

FIG. 14 depicts another exemplary process flow according to additional embodiments of the disclosure. There is shown a process flow 1400 according to embodiments of the disclosure. At block 1402 Joule heat is generated in a fuse component in response to an overcurrent or fault current. The fuse component may be any known fuse component in different embodiments. The Joule heat refers to heating due to electrical resistance of current passing through the fuse element.

At block 1404, the Joule heat is transmitted to a phase change component having a phase change material (PCM) in thermal contact with the fuse component. The Joule heat causes the temperature of the fuse component and phase change component to increase. The phase change component may be in direct physical contact with the fuse component or indirect physical contact, where a good thermal conductor may be disposed between the fuse component and phase change component.

At block 1406 a phase transition is generated when the temperature of the phase change component reaches a phase change temperature. During the phase transition, the temperature of the phase change component and the temperature of the fuse component may remain constant or nearly constant.

At block 1408, the fuse component temperature increases by continued generation of Joule heat from the overcurrent, after the phase transition of the phase change component is complete.

At block 1410, the fuse component is tripped when the fuse temperature is reached. In various embodiments, the fuse delay provided by the phase change component may be tailored according to the application. In some cases, the time of fuse delay may be very substantial, such as on the order of seconds or tens of seconds.

While the present embodiments have been disclosed with reference to certain embodiments, numerous modifications, alterations and changes to the described embodiments are possible while not departing from the sphere and scope of the present disclosure, as defined in the appended claims. Accordingly, the present embodiments are not to be limited to the described embodiments, and may have the full scope defined by the language of the following claims, and equivalents thereof.

What is claimed is:

1. A resettable fuse device, comprising:

a fuse component;

a first electrode, disposed on a first side of the fuse component;

a second electrode, disposed on a second side of the fuse component; and a phase change component, disposed in thermal contact with the fuse component, wherein the fuse component comprises a fuse temperature;

wherein the phase change component exhibits a phase change temperature, the phase change temperature marking a phase transition of the phase change component, wherein the phase change temperature is less than the fuse temperature, and wherein the phase change component is disposed between the first electrode and the second electrode.

2. The resettable fuse device of claim 1, wherein the phase change component comprises a polymer, a wax, a metal, metal alloy, a salt hydrate, or a eutectic material.

3. The resettable fuse device of claim 1, wherein the fuse component comprises a positive temperature coefficient (PTC) material, wherein the PTC material comprises a trip temperature, the trip temperature separating a low resistance state of the PTC material from a high resistance state of the PTC material.

4. The resettable fuse device of claim 1, wherein the first electrode comprises:

an inner side, the inner side disposed in direct contact with the fuse component; and an outer side, wherein the phase change component is disposed on the outer side of the first electrode.

5. The resettable fuse device of claim 4, wherein the second electrode comprises:

a second inner side, the second inner side disposed in direct contact with the fuse component; and a second outer side, wherein the phase change component is disposed on the second outer side of the second electrode.

6. The resettable fuse device of claim 1, wherein the phase change component is disposed in direct contact with the fuse component.

7. The resettable fuse device of claim 1, wherein the phase change component comprises:

an encapsulant layer; and a phase change material, wherein the phase change material is characterized by a phase transition temperature, and wherein the phase change material is encapsulated by the encapsulant layer.

8. The resettable fuse device of claim 1, wherein the phase change component comprises a phase change material, and wherein the phase transition comprises a melting of the phase change material.

9. The resettable fuse device of claim 1, wherein the phase change component comprises:

a matrix material; and plurality of microencapsulated particles, wherein the plurality of microencapsulated particles are dispersed within the matrix material, and wherein the plurality of microencapsulated particles comprises a phase change material, the phase change material being characterized by the phase transition.

10. The resettable fuse device of claim 3, wherein the phase change component comprises a plurality of microencapsulated particles, wherein the plurality of microencapsulated particles are dispersed within the PTC material.

11. The resettable fuse device of claim 1, wherein the phase change temperature is less than 150° C.

12. The resettable fuse device of claim 1, wherein the phase change component comprises a tape, wherein the tape is disposed on the first electrode, and comprises a phase change material characterized by the phase change temperature.

13. The resettable fuse device of claim 1, wherein the phase change component comprises a coating, the coating being disposed on the first electrode and comprising a phase change material characterized by the phase change temperature.

14. The resettable fuse device of claim 1, wherein the phase change component comprises a shape stabilized phase change material, the shape stabilized phase change material comprising:

a cross-linked polymer matrix; and a plurality of microencapsulated particles, the plurality of microencapsulated particles dispersed within the cross-linked polymer matrix, and being characterized by the phase change temperature.

15. The resettable fuse device of claim 1, wherein the fuse component comprises a metal oxide varistor.

16. A resettable fuse device, comprising:

a fuse component;

a first electrode, disposed on a first side of the fuse component;

a second electrode, disposed on a second side of the fuse component; and a phase change component, disposed in thermal contact with the fuse component, wherein the fuse component comprises a fuse temperature;

wherein the phase change component exhibits a phase change temperature, the phase change temperature marking a phase transition of the phase change component, wherein the phase change temperature is less than the fuse temperature, and wherein the phase change component comprises:

an encapsulant layer; and a phase change material, wherein the phase change material is characterized by a phase transition temperature, and wherein the phase change material is bounded by the encapsulant layer on a first side and is bounded by the first electrode on a second side.

* * * * *